US007070409B1

(12) United States Patent
Varrieur

(10) Patent No.: US 7,070,409 B1
(45) Date of Patent: Jul. 4, 2006

(54) REPLACEMENT CANDLE INSERT KIT AND METHOD FOR USING THE SAME

(76) Inventor: Trudi Varrieur, 21 Woodhawk Way, Litchfield, NH (US) 03052

( * ) Notice: Subject to any disclaimer, the term of this patent is extended or adjusted under 35 U.S.C. 154(b) by 199 days.

(21) Appl. No.: 10/703,736

(22) Filed: Nov. 7, 2003

Related U.S. Application Data

(60) Provisional application No. 60/424,432, filed on Nov. 7, 2002.

(51) Int. Cl.
*F23D 3/16* (2006.01)

(52) U.S. Cl. ..... 431/291; 431/292; 431/297

(58) Field of Classification Search ..... 431/291 O, 431/292 X, 297 X, 120, 122, 253
See application file for complete search history.

(56) References Cited

U.S. PATENT DOCUMENTS

| | | | | |
|---|---|---|---|---|
| 2,354,343 | A | | 7/1944 | Webber |
| 2,481,019 | A | | 9/1949 | Joyce |
| 2,713,256 | A | | 7/1955 | Oesterle et al. |
| 2,974,509 | A | | 3/1961 | Penke |
| 3,466,135 | A | | 9/1969 | Summers |
| 3,741,711 | A | | 6/1973 | Bryant |
| 4,568,270 | A | * | 2/1986 | Marcus et al. ..... 431/288 |
| 4,755,135 | A | | 7/1988 | Kwok |
| 4,917,597 | A | | 4/1990 | Henze |
| 5,395,233 | A | | 3/1995 | Karp |
| 5,537,989 | A | * | 7/1996 | York et al. ..... 126/406 |
| 5,597,300 | A | | 1/1997 | Wohl et al. |
| 5,651,669 | A | | 7/1997 | Henry |
| 5,690,484 | A | | 11/1997 | Leonard et al. |
| 6,036,477 | A | | 3/2000 | Frandsen |
| 6,059,564 | A | | 5/2000 | Morris |
| 6,290,489 | B1 | | 9/2001 | Seidler |
| 6,375,455 | B1 | | 4/2002 | Frandsen et al. |
| 6,435,694 | B1 | | 8/2002 | Bell et al. |
| 6,439,471 | B1 | | 8/2002 | Ehrlich et al. |

* cited by examiner

*Primary Examiner*—Alfred Basichas
(74) *Attorney, Agent, or Firm*—Maine & Asmus

(57) ABSTRACT

A method, apparatus and kit for the installation of a replacement candle insert holder in a decorative candle are disclosed. A cup like holder is securely anchored into the core of a decorative wax candle after manufacture of the candle. The holder can be installed either by the consumer, retailer, or manufacturer of the candle. Replacement candles may then be inserted into the holder and burned without consuming the decorative outer candle.

19 Claims, 2 Drawing Sheets

REPLACEMENT CANDLE INSERT KIT AND METHOD FOR USING THE SAME

RELATED APPLICATION

This application claims the benefit of U.S. Provisional Application No. 60/424,432, filed Nov. 7, 2002.

FIELD OF THE INVENTION

The invention relates to candles, and more particularly, to replaceable candle inserts and means for mounting the same.

BACKGROUND OF THE INVENTION

Candles have long been known as means of illumination. Today, when illumination is available from other, more economical sources, like the incandescent light bulb, or florescent lights, candles are used more for decorative effect and ambiance. As their utilitarian function has been eclipsed by their decorative function, candles have been made in ornate and decorative patterns. An example of such an ornate style of candle is a "cut and carve" or a "cut and curl" candle, wherein a solid wax core, suspended by its wick is dipped in molten wax building up layers, the layers can be of different colors. The wax body is then cut exposing the layers of multi-colored wax. The portions cut off may be twisted and reattached, forming arabesques and other fanciful designs. These candles are labor intensive to manufacture, and in many cases are individually commissioned. Such candles are costly, and if damaged would be unsuitable for their primary function, decoration.

It is the nature of candles to be consumed or burnt when used. The expense associated with burning a decorative candle may cause the consumer to be reluctant to purchase or, if purchased, to light such a candle. The flame that provides illumination also heats and melts the wax of the candle. The candle, particularly if it is wide, or with external decoration, may be melted unevenly, causing the exterior of the candle to deform.

What is needed, therefore, are techniques for cost effectively replacing wax consumed when a candle burns and preventing heat deformation of costly decorative candles.

BRIEF SUMMARY OF THE INVENTION

Embodiments of the present invention include a kit for the installation of a replaceable candle insert holder in a decorative candle, the kit may include a liquefied wax extraction tool that removes liquefied wax from a candle, forming a cavity in the candle; a smoothing tool for smoothing irregularities in walls of the cavity; a replacement candle insert holder designed to be disposed within the cavity; and at least one fastener anchoring replacement candle insert holder to the candle. The kit may also include at least one replacement candle insert light configured to be disposable within said replacement candle insert holder.

A further embodiment of the present invention is replacement insert light apparatus for extending the useful life of a decorative candle indefinitely comprising a replacement insert light holder, configured to be disposed within a cavity formed in a decorative candle a fastener anchoring the replacement light holder to the decorative candle; and a replacement insert light disposable within the replacement light holder.

Another embodiment of the present invention is a method for the installation of a replacement candle insert holder in a decorative candle comprising the steps of: lighting the decorative candle and allowing the candle to burn, allowing wax near the wick of the candle to liquefy; removing said liquefied wax using a wax extraction tool thereby forming a cavity; smoothing the irregular interior of the cavity, adapting the cavity to receive a replacement candle insert holder; inserting a replacement candle insert holder into said cavity; anchoring the replacement candle insert holder by inserting a fastener through the holder, and driving the fastener into the decorative candle.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

One embodiment of the present invention comprises a kit having components necessary for the installation and mounting of a replacement light holder in a cavity that has been formed in decorative candle.

Figure 1:
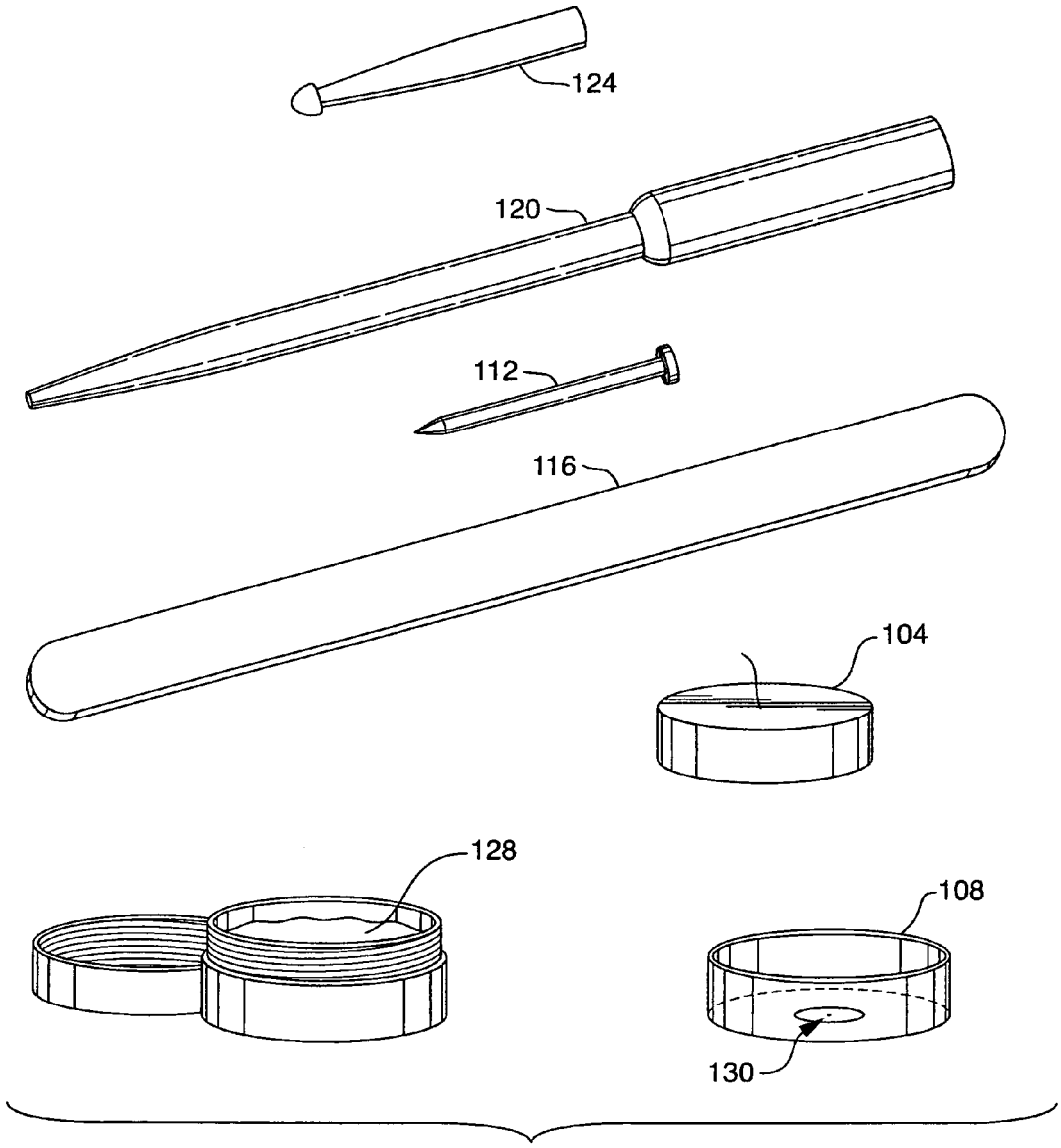
FIG. 1 is a perspective view illustrating a kit in accordance with one embodiment of the present invention.

Referring now to FIG. 1, which illustrates a kit according to one embodiment of the present invention. The kit may include at least one replacement insert light 104, a replacement insert light holding cup 108, at least one fastener 112, a smoothing tool 116, a wax extraction tool 120, an applicator 124, and a quantity of glaze 128.

The replacement insert light 104, according to one embodiment of the present invention, is of a diameter small enough to fit loosely in the replacement insert light holding cup 108. In one embodiment, the replacement insert light is a cylinder of wax, ⅝ inch high, 1⅛ inches in diameter, having a wick disposed within it. The wax may in some embodiments be perfumed, such that when lit the perfume is diffused through the air imparting a pleasant fragrance to the room in which the light is burning.

The replacement insert light holding cup 108 is a cup configured to receive the replacement insert light 104 having at least one aperture 130 through which at least one fastener 112 is inserted, thereby anchoring the cup in the decorative candle. The cup 108, according to one embodiment, comprises a substantially non-heat conductive material. One example of such a material is plastic. In one embodiment, the cup 108 is comprised of a commercially available tea light holder or mold. In this embodiment, at least one hole or aperture 130 is drilled through about approximately the center of its base. According to one embodiment, the cup 108 has a circular base with an external diameter of 1.5 inches and a sidewall 0.75 inch high.

Alternatively, the cup 108 may not have an aperture 130, instead, the fastener 112 may be integrally incorporated into the cup 108.

According to one embodiment of the present invention, at least one fastener 112 is separate from and is inserted through the base of the cup 108 during the installation process. The fastener 112 may comprise a heat conductive material with a high resistance to breakage and bending. An example of such a material is steel. According to one embodiment of the present invention, the fastener 112, is a steel nail. During installation, heating the steel softens the surrounding wax, permitting the nail to be inserted with the pressure from a thumb or finger. One skilled in the art would readily appreciate that other embodiments, wherein the fastener is not heat conductive, would likewise be within the scope of the present invention. For example, wooden or plastic fasteners may be used. Likewise, one of ordinary skill in the art will readily appreciate that the fastener 112 may be a material that is applied in a liquid or paste form into which the insert light holding cup 108 is placed; the liquid or paste fastener material then hardening with time so as to secure the cup 108. One example of such a material is liquid candle glaze 128 applied to a cavity in the candle wherein the insert light holding cup 108 is disposed, and which, once hardened, would hold the cup 108 in place and would prevent melting or scorching of the candle.

One skilled in the art would readily appreciate that the fastener 112 is susceptible to a variety of geometries. Examples include, but are not limited to nails, pins, picks, cork screws, screws, staples, toggles, and anchors. In some embodiments, it is desirable to have a fastener long enough to embed in non-softened wax, while in other embodiments it is desirable to be embedded only in the wax softened by the burning process, which, when re-solidified would hold the fastener firmly in place.

According to one method in accord with an embodiment of the present invention, in order for the cup 108 to be inserted into the decorative candle, after the candle has been manufactured, wax must be excavated from the decorative candle to provide a depression or cavity in which to lodge the cup 108. One method, among many, for achieving such excavation is to burn the candle in a controlled way. One drawback to this method is that hot wax may melt or deform the exterior if not promptly removed. One embodiment of the present invention includes a wax extraction tool 120. The wax extraction tool 120 allows the installer to remove the hot wax. The extractor tool 120, may according to one embodiment of the present invention be a commercially available polyethylene pipet. Alternatives such as syringes, ladles, or spoons may also be used. Once the cavity has been created in this way, it will have irregularities that would make seating the cup 108 difficult. A smoothing tool 116 may also be provided. The tool should be resistant to the heat of the softened wax, and have either a flat or scooped surface. In one embodiment, the smoothing tool 116 is a commercially available wooden tongue depressor, craft stick, or POPSICLE® stick. No claim is made to the registered trademark POPSICLE®. In embodiments where the wax extraction tool is a spoon or ladle, one of ordinary skill in the art will readily appreciate that the smoothing tool 116 and the wax extraction tool 120 may be disposed upon a common handle.

Once the cavity has been formed for receiving the cup 108, the cup 108 may be seated in the cavity and installed. In embodiments where the fastener 112 is integral to the cup, the installer must press on the cup 108 to insure proper seating. In embodiments where the fastener is introduced through the at least one aperture 130 in the cup 108, the cup may be aligned in the cavity, and the fastener 112 inserted afterward. The cup 108, in some embodiments, is inserted while the wax of the candle is still pliable, facilitating the introduction of the fastener 112. The fastener 112 may also be heated to ease anchoring without cracking or otherwise damaging the candle.

According to one embodiment of the present invention, once the cup has been installed, a commercially available candle glaze 128 is applied to exposed interior surfaces of the candle to prevent the heat from the flame of the replacement insert light 104 from melting the interior of the candle and thereby deforming the exterior of the candle. This glaze 128 may be applied using an applicator 124. According to one embodiment of the present invention, the applicator 124 is a commercially available cosmetic applicator having a sponge head and rigid handle.

Figure 2:
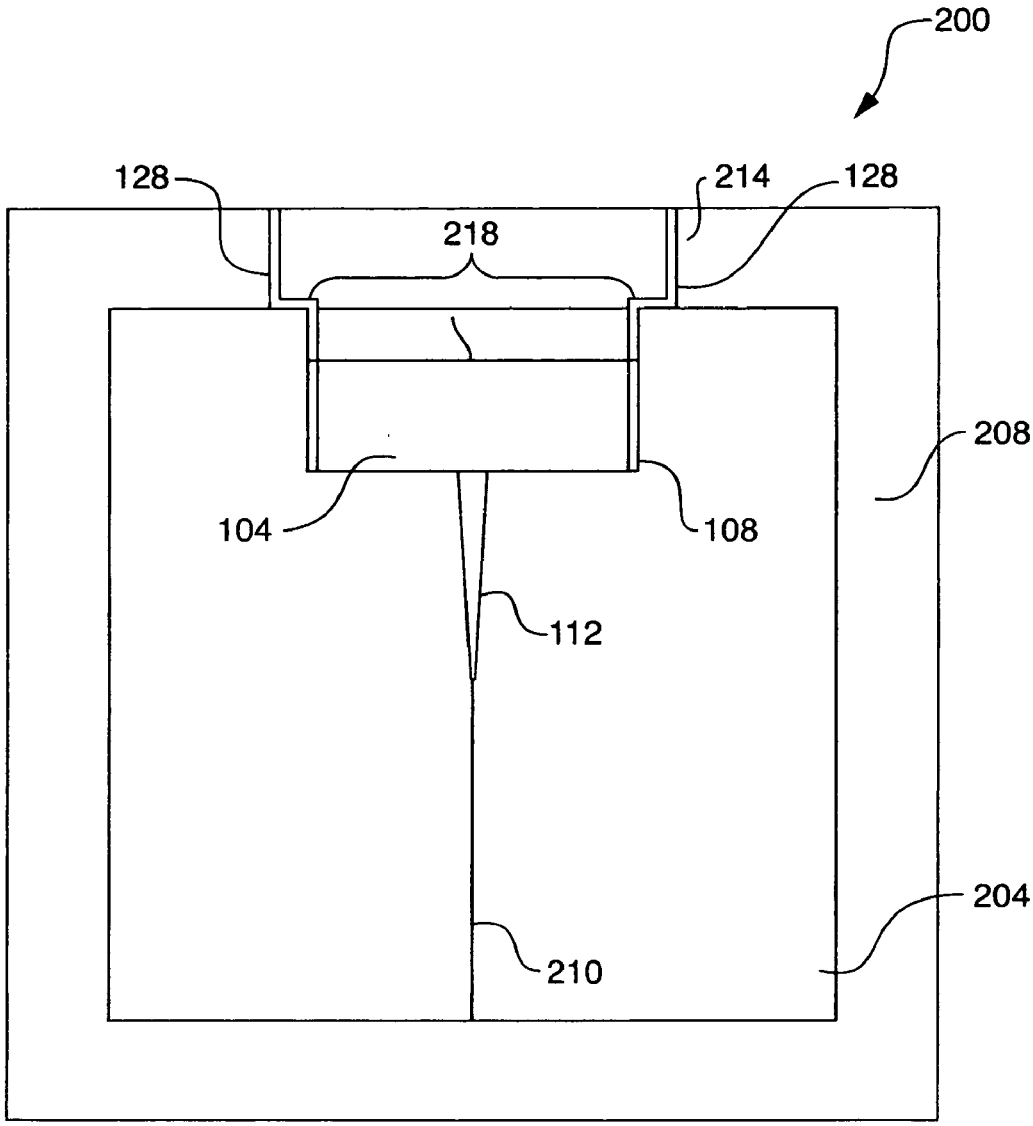
FIG. 2 is a cross sectional elevational view of a candle wherein a kit in accordance with one embodiment of the present invention has been installed.

Referring now to FIG. 2, which is a cross sectional elevational view of a decorative candle 200 wherein the replacement insert light system according to one embodiment of the present invention has been installed. The candle itself, according to one embodiment, of the present invention includes: a wax core 204, a layer of external wax decoration 208, and a wick 210. The layer of external wax decoration 208 coats the wax core 204 through which the wick 210 runs. During production the layer of wax decoration 208 has been removed, at the top of the candle 200, around the wick 210, to create a well 214 to collect molten wax that might otherwise drip down the side of the candle. The layer of external decoration 208 as in "Cut and Curl" candles may comprise a plurality of layers of wax of various colors, as well as recesses and external protrusions. It would be readily apparent to one skilled in the art that the present invention would be eminently useful in other types of decorative candles.

According to one embodiment of the present invention, a deeper post-production recess is located 218 within the well 214 and the cup 108 is located therein. The fastener 112 is driven through the aperture 130 in the cup 108, and into the wax core 204, anchoring the cup in place. Glaze 128 coats the interior surfaces of the well 214 preventing the interior surfaces from liquefying from the heat of a replacement candle insert 104.

According to one embodiment of the present invention, the candle 200 is lit, consuming some wax and liquefying more wax. The liquefied wax may be removed using a wax extraction tool 120. The surfaces of the recess 218 created by the extraction of the liquefied wax are then smoothed using a smoothing tool 116. The replacement candle insert holder 108 is then located in the recess 218, and securely anchored by driving the fastener 112 through into the wax core 204. A glaze 128 is applied to the interior exposed wax surfaces of the recess 218 and well 214 using an applicator 124.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but only by the claims appended hereto.

I claim:

1. A kit for the installation of a replaceable candle insert holder in a decorative candle, the kit comprising:

a liquefied wax extraction tool whereby liquefied wax is removed from a candle, thereby forming a cavity in said candle;

a smoothing tool whereby irregularities in walls of said cavity are smoothed;

a replacement candle insert holder configured to be disposed within said cavity; and at least one fastener, whereby said replacement candle insert holder is anchored to said candle.

2. The kit of claim 1 further comprising at least one replacement candle insert light configured to be disposed within said replacement candle insert holder.

3. The kit of claim 2 wherein said replacement candle insert light is perfumed.

4. The kit of claim 1 wherein said liquefied wax extraction tool comprises at least one liquid transfer tool selected from the group of liquid transfer tools consisting of syringes, spoons, ladles, pipettes, and scoops.

5. The kit of claim 1 wherein said smoothing tool comprises a member of substantially heat resistant material.

6. The kit of claim 5 wherein said substantially heat resistant material is selected from the group of substantially heat resistant materials consisting of plastic and wood.

7. The kit of claim 1 wherein said smoothing tool comprises a tool selected from the group of tools consisting of spatulas, tongue depressors, spoons, and craft sticks.

8. The kit of claim 1 wherein said smoothing tool and said wax extraction tool are disposed on a common handle.

9. The kit of claim 1 wherein said fastener comprises:

at least one shaft having first and second ends;

said first end comprising a means for mating with said replacement candle insert holder;

said second end comprising a pointed tip.

10. The kit of claim 1 wherein said fastener comprises at least one fastener chosen from the group of fasteners consisting of candle glaze, nails, staples, pins, screws.

11. The kit of claim 1 wherein said replacement candle insert holder is configured with at least one aperture for receiving said fastener.

12. A replacement insert light system for extending the useful life of a decorative candle indefinitely comprising:

a replacement insert light holder, configured to be disposed within a cavity formed in a decorative candle;

a fastener whereby said replacement light holder is anchored to said decorative candle said fastener comprising at least one shaft having first and second ends;

said first end comprising a means for mating with said replacement candle insert holder;

said second end comprising a pointed tip; and a replacement insert light disposed within said replacement light holder.

13. The system of claim 12 wherein said fastener comprises at least one fastener chosen from the group of fasteners consisting of nails, staples, pins, screws.

14. The system of claim 12 wherein said replacement candle insert holder is configured with at least one aperture for receiving said fastener.

15. The system according to claim 14 wherein said fastener comprises a metal fastener.

16. A method for the installation of a replacement candle insert holder in a decorative candle comprising the steps of:

lighting said decorative candle and allowing said candle to burn thereby allowing wax proximate a wick in said decorative candle to liquefy;

removing said liquefied wax using a wax extraction tool thereby forming a cavity;

smoothing irregularities in interior surfaces of said cavity thereby adapting said cavity to receive a replacement candle insert holder;

inserting a replacement candle insert holder into said cavity;

anchoring said replacement candle insert holder by inserting a fastener through said holder, and driving said fastener into said decorative candle.

17. The method of claim 16 further comprising the step of heating said fastener.

18. The method of claim 16 further comprising the step of applying a glaze to said cavity.

19. The method of claim 16 diffusing a pleasant scent through a room by placing a replacement candle insert in said replacement light insert holder and lighting said replacement candle insert.

* * * * *